US007102065B2

(12) United States Patent
Sperzel

(10) Patent No.: US 7,102,065 B2
(45) Date of Patent: Sep. 5, 2006

(54) TUNING DEVICE

(76) Inventor: Robert J. Sperzel, 7810 Lake Ave., Cleveland, OH (US) 44102

( * ) Notice: Subject to any disclaimer, the term of this patent is extended or adjusted under 35 U.S.C. 154(b) by 271 days.

(21) Appl. No.: 10/315,306

(22) Filed: Dec. 10, 2002

(65) Prior Publication Data

US 2004/0107819 A1 Jun. 10, 2004

(51) Int. Cl.
*G10D 3/14* (2006.01)

(52) U.S. Cl. ..... 84/304

(58) Field of Classification Search ..... 84/304, 84/305, 306

See application file for complete search history.

(56) References Cited

U.S. PATENT DOCUMENTS 3,431,807 A 3/1969 Thompson
4,353,280 A 10/1982 Spercel
4,625,614 A 12/1986 Spercel
5,728,955 A 3/1998 Sperzel
6,023,014 A 2/2000 Sperzel
6,172,287 B1 * 1/2001 Kang ..... 84/304
6,365,809 B1 * 4/2002 Steinberger ..... 84/304
6,608,248 B1 * 8/2003 Sperzel ..... 84/306

* cited by examiner

*Primary Examiner*—Kimberly Lockett
(74) *Attorney, Agent, or Firm*—Tarolli, Sundheim, Covell & Tummino LLP

(57) ABSTRACT

An apparatus for use in tuning a string of a musical instrument includes a shaft which extends from a pinion gear. A sleeve is fixedly connected to the shaft and encloses an end portion of the shaft. The sleeve has an end portion which receives a string of a musical instrument. The shaft may be integrally formed as one piece with the pinion gear. A force transmitting member may be provided between an end portion of the sleeve and a housing. A retainer portion of the sleeve may extend into a recess in the shaft. A grommet may extend around the sleeve to retain the sleeve against transverse movement.

68 Claims, 3 Drawing Sheets

TUNING DEVICE

BACKGROUND OF THE INVENTION

The present invention relates to a new and improved tuning device tuning for a string of a musical instrument, such as a guitar.

A known tuning device for a string of a musical instrument is disclosed in U.S. Pat. No. 4,353,280. This known tuning device includes a housing. A pinion gear is disposed in meshing engagement with a worm gear in the housing. A shaft extends from the pinion gear through at least a portion of a base of the housing.

The tuning device disclosed in the aforementioned U.S. Pat. No. 4,353,280 has a housing which fully encloses both the worm and pinion gear. Vintage guitars may have a housing which leaves the pinion gear exposed. A housing for a vintage guitar is disclosed in U.S. Design Pat. No. 267,410. The manner in which a pinion gear and worm gear may be mounted in a housing for a vintage guitar is illustrated in U.S. Design Pat. No. 256,471.

In the past, the difficulty has been encountered in optimizing the playing characteristics of tuning devices used on stringed musical instruments. In addition, difficulty has also been encountered in satisfactorily mounting tuning devices on a stringed musical instrument. These difficulties are encountered with guitars of the vintage and non-vintage type. These difficulties are also encountered with other known stringed musical instruments.

SUMMARY OF THE INVENTION

The present invention relates to a new and improved apparatus for use in tuning a string of a musical instrument. The apparatus includes a housing and a pinion gear which is disposed adjacent to a base of the housing. A shaft extends from the pinion gear. A sleeve may be connected with the shaft and enclose an end portion of the shaft. The sleeve may have an end portion which receives the string of the musical instrument.

The shaft may advantageously be integrally formed as one piece with the pinion gear. To connect the shaft and pinion gear with the housing, a force transmitting member may be provided between an end portion of the sleeve and the housing. A retainer portion of the sleeve may extend into engagement with a recess in the shaft to interconnect the sleeve and shaft. If desired, a grommet may extend around the sleeve to retain the sleeve against transverse movement relative to the musical instrument while supporting the sleeve for rotational movement relative to the musical instrument.

Tuning devices constructed in accordance with the present invention may be utilized on many different types of stringed musical instruments, including guitars of the vintage and non-vintage type. The tuning devices may be utilized in association with banjos or mandolins. It should be understood that a tuning device having one or more features of the present invention may be utilized in association with any desired type of stringed musical instrument.

The tuning devices of the present invention have a plurality of features. These features may be utilized in various combinations with each other. Alternatively, the features may be used separately in association with features of known devices.

BRIEF DESCRIPTION OF THE DRAWINGS

The foregoing and other features of the present invention will become more apparent upon a consideration of the following description taken in connection with the accompanying drawings wherein.

DESCRIPTION OF SPECIFIC PREFERRED EMBODIMENTS OF THE INVENTION

General Description

Figure 1:
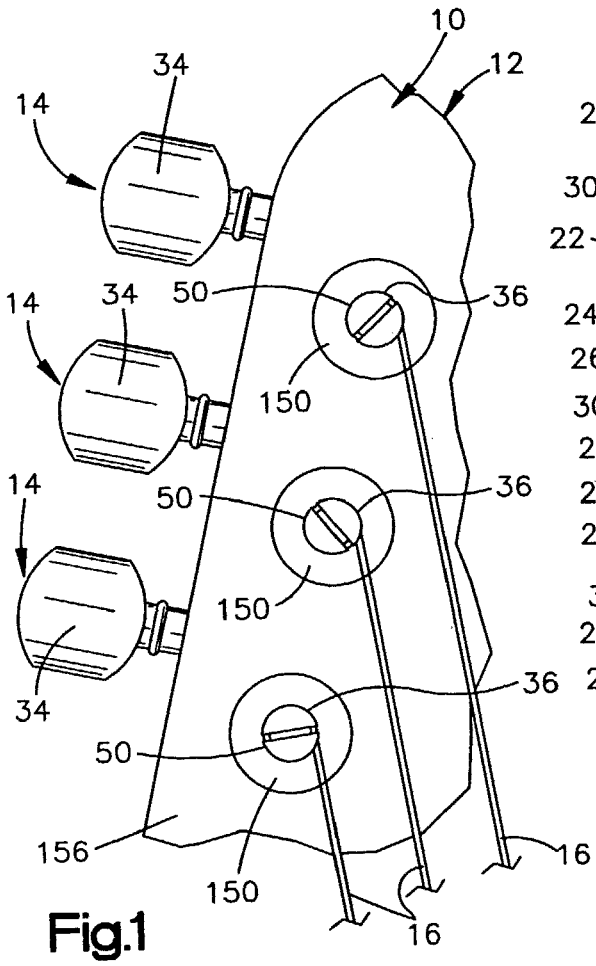
FIG. 1 is a fragmentary schematic pictorial illustration of a front side of a head end portion of a stringed musical instrument.
Figure 2:
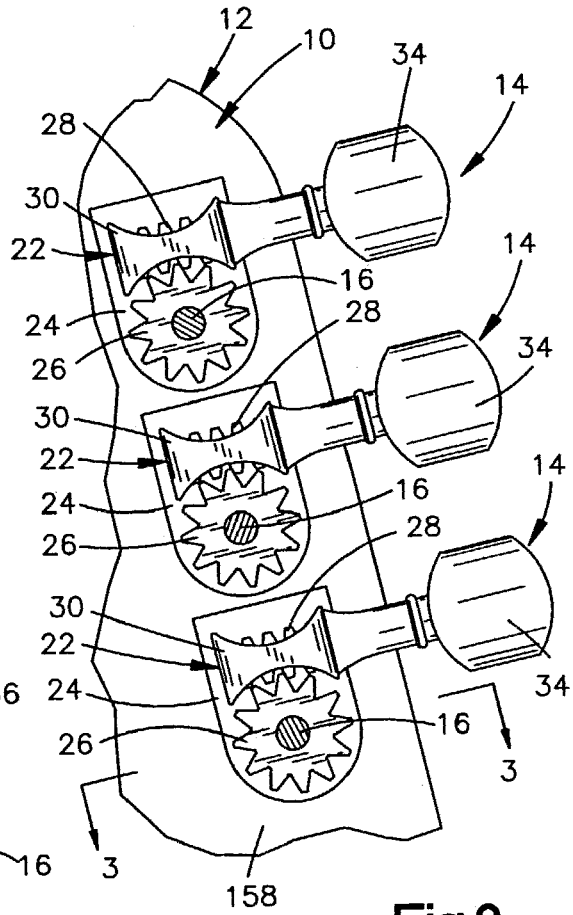
FIG. 2 is a fragmentary schematic pictorial illustration, generally similar to FIG. 1, of the back side of the head end portion of the stringed musical instrument of FIG. 1.

The head end portion 10 of a stringed musical instrument 12 is illustrated in FIG. 1. Tuning devices 14 are mounted on the wooden head end portion 10 of the stringed musical instrument 12 (FIGS. 1 and 2). The tuning devices 14 are manually operable to tune strings 16 (FIG. 1) of the musical instrument 12. The stringed musical instrument 12 is a guitar. However, the tuning devices 14 may be associated with strings 16 of many different types of stringed musical instruments. For example, the tuning devices 14 may be utilized with a string 16 of a banjo or mandolin.

In order to provide the guitar 12 with a vintage appearance, a metal housing 22 (FIG. 2) includes a base 24 on which an exposed metal pinion gear 26 is disposed. The rotatable pinion gear 26 is disposed in meshing engagement with a metal worm 28. The worm 28 is partially enclosed by an upper wall 30 of the housing 22. The upper wall 30 extends parallel to the base 24 of the housing 22.

The housing 22 has a vintage appearance and construction which is similar to the appearance and construction of the tuning device housing disclosed in U.S. Design Pat. No. 267,410. The worm 28 is rotatably supported by side walls of the housing. The side walls of the housing extend between and perpendicular to the upper wall 30 and the base 24 of the housing. It should be understood that the housing 22 may have a different appearance if desired. For example, the housing 22 may have an appearance and construction similar to the appearance and construction of any one of the housings disclosed in U.S. Pat. Nos. 3,431,807 and 6,023,014.

A metal knob 34 is manually rotatable to rotate the worm 28. Rotation of the worm 28 is effective to rotate the circular pinion gear 26 and a cylindrical metal string post 36 (FIGS.

1 and 3). Rotation of the string post 36 is effective to vary the tension in an associated one of the strings 16 of the musical instrument 12.

The housing 22, pinion gear 26 and worm 28 (FIG. 2) cooperate in the same manner as is disclosed in U.S. Design Pat. No. 256,471. The housing 22 encloses most of the worm 28. The pinion gear 26 is disposed on the base 24 of the housing and is exposed to view. However, if desired, the housing 22 may be constructed so as to enclose both the pinion gear 26 and worm 28.

Tuning Device

Figure 3:
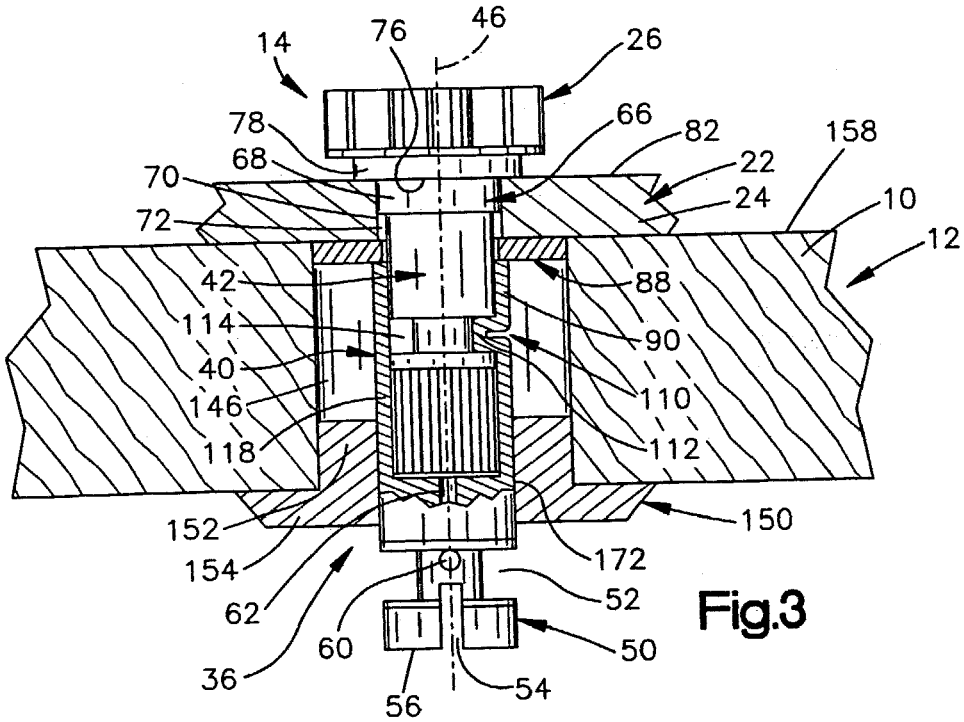
FIG. 3 is an enlarged fragmentary schematic sectional view, taken generally along the line 3—3 of FIG. 2, illustrating the construction of a portion of a tuning device for the stringed musical instrument of FIGS. 1 and 2.
Figure 4:
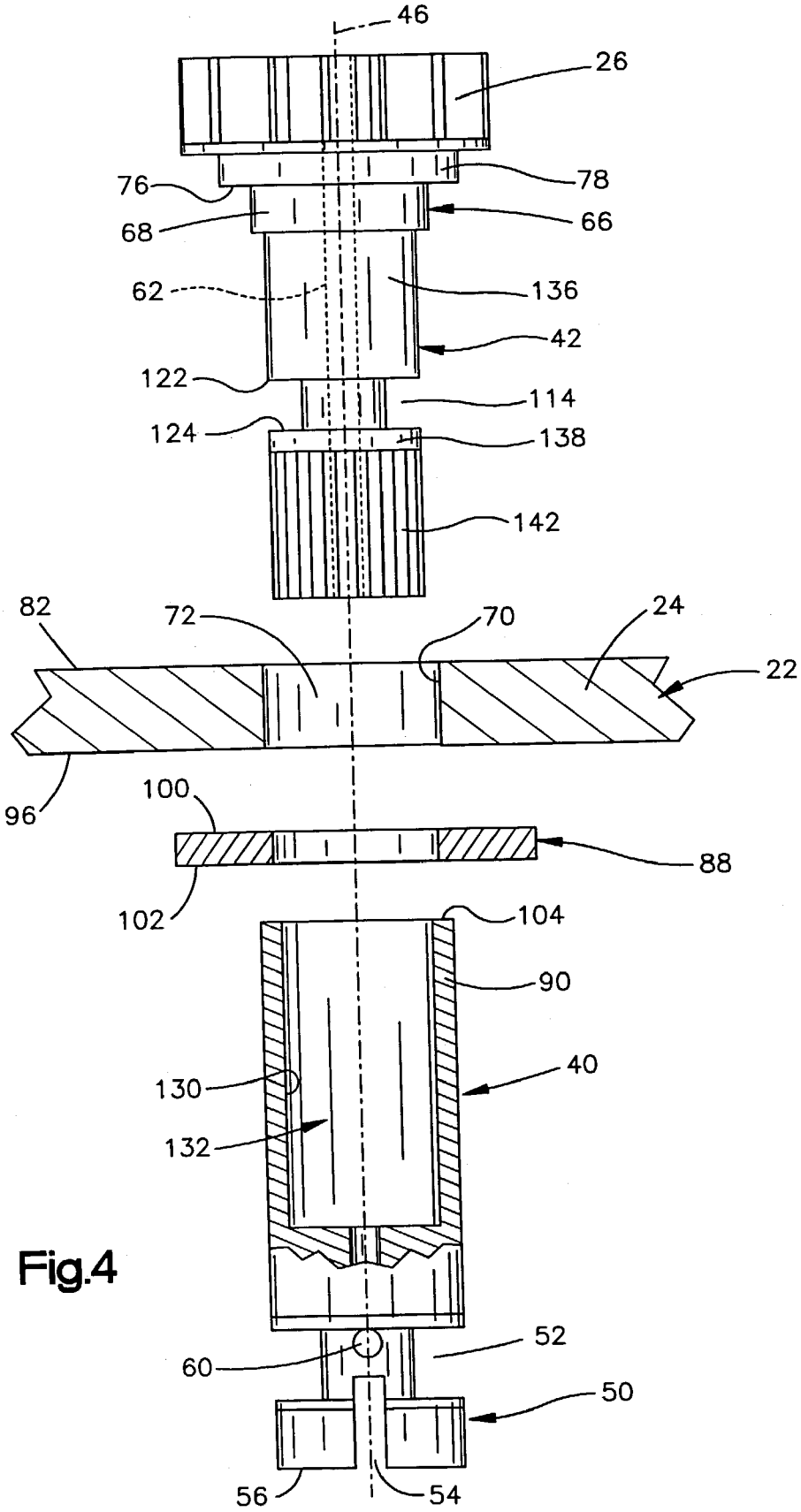
FIG. 4 is an enlarged fragmentary exploded illustration of a portion of the tuning device of FIGS. 1–3.

In accordance with one of the features of the present invention, the string post 36 includes a sleeve 40 which encloses a shaft 42 (FIGS. 3 and 4). The shaft 42 is fixedly connected with the pinion gear 26 and is telescopically received in the sleeve 40 (FIG. 3). The sleeve 40 and shaft 42 are disposed in a coaxial relationship with the pinion gear 26.

When the knob 34 (FIG. 2) is manually rotated, the resulting rotation worm 28 causes the circular pinion gear 26 to rotate about its central axis 46 (FIG. 3). Rotation of the metal pinion gear 26 causes rotation of the cylindrical metal shaft 42 about the axis 46. The shaft 42 is fixedly connected with the cylindrical metal sleeve 40. Therefore, the pinion gear 26, shaft 42 and sleeve 40 all rotate together about their common central axis 46 when the knob 34 is manually rotated.

The lower (as viewed in FIGS. 3 and 4) end portion 50 of the cylindrical metal string post 36 is adapted to receive a string 16 (FIG. 1) of the musical instrument 12. The end portion 50 of the sleeve 36 includes an annular groove 52 (FIGS. 3 and 4) which extends around the end portion 50 of the cylindrical sleeve 40. The annular groove 52 has a central axis which is coincident with the central axis 46 of the string post 36. In addition, the end portion 50 of the one piece metal sleeve 40 has a slot 54 which extends axially inward from a circular end surface 56 of the sleeve 40. The slot 54 extends diametrically across the end portion 50 of the sleeve 40 and intersects the central axis 46 of the string post 36.

The string 16 extends along the head end portion 10 (FIG. 1) of the musical instrument 12 to the annular groove 52 (FIG. 3). The string 16 extends around a portion of the annular groove 52 and into the slot 54. The string 16 extends from the slot 54 into a circular entrance 60 to a string passage 62. The string passage 62 extends from the entrance 60 in the annular groove 52 through the string post and through the pinion gear 26. An end portion of the string 16 extends from the pinion gear 26 and can be manually pulled to establish initial tension in the string. Rotation of the knob 34 is then effective to tighten the string with a desired tension.

The manner in which the string 16 extends through the string post 36 and pinion gear 26 and cooperates with the annular groove 52 and slot 54 in the end portion 50 of the sleeve 40 is the same as is disclosed in U.S. patent application Ser. No. 10/102,118 filed Mar. 20, 2002 by Robert J. Sperzel and entitled Device For Tuning A String Of A Musical Instrument. The disclosure in the aforementioned application Ser. No. 10/102,118 is hereby incorporated herein in its entirety by this reference thereto.

It is contemplated that the string 16 may cooperate with the tuning device 14 in a different manner and that the end portion 50 of the tuning device may have a different construction if desired. For example, the string post 36 and sleeve 40 may be constructed so as to enable the string 16 to be gripped and tensioned in a manner similar to that in either U.S. Pat. No. 4,353,280 or U.S. Pat. No. 4,625,614. Of course, the string post 36 and end portion 50 of the sleeve 40 may be constructed in a different manner to cooperate with a string 16 in other ways if desired.

In accordance with another feature of the invention, the shaft 42 and pinion gear 26 are integrally formed from a single piece of metal. By integrally forming the shaft 42 as one piece with the pinion gear 26, construction of the pinion gear and shaft with a common central axis 46 is facilitated. In addition, relative movement between the pinion gear 26 and shaft 42 during playing of the musical instrument is eliminated.

A bearing 66 is disposed between the shaft 42 and pinion gear 26. The cylindrical bearing 66 is integrally formed as one piece with the pinion gear 26 and shaft 42. The bearing 66 has a cylindrical bearing surface 68 which engages a cylindrical bearing surface 70 at a circular opening 72 formed in the base 24 of the housing 22. The bearing surface 68 has a central axis which is coincident with the axis 46. Therefore, the pinion gear 26, bearing surface 68, and shaft 42 are all disposed in a coaxial relationship.

In addition to being supported for rotational movement relative to the housing 22 by the bearing 66, the pinion 26 is supported for rotational movement relative to the housing 22 by a flat annular bearing surface 76 formed on a cylindrical shoulder 78. The shoulder 78 is disposed in a coaxial relationship with the pinion gear 26, bearing 66 and shaft 42. The bearing surface 76 on the shoulder 78 is disposed in engagement with an upper (as viewed in FIGS. 3 and 4) side surface 82 of the base 24 of the housing 22.

The pinion gear 26, shoulder 78, bearing 66, and shaft 42 are all integrally formed from a single piece of metal. To form the pinion gear 26, shoulder 78, bearing 66, and shaft 42, a single cylindrical piece of metal may be machined in a known manner. By forming the pinion gear 26, shoulder 78, bearing 66 and shaft 42 from a single piece of metal, forming them with a common central axis 46 is facilitated.

In accordance with another feature of the present invention, an annular metal force transmitting member 88 is disposed between an end portion 90 of the sleeve 40 and the base 24 of the housing 22. The force transmitting member 88 and shoulder 78 engage upper and lower major side surfaces 82 and 96 (FIG. 4) of the base 24 of the housing 22 to prevent axial movement of the string post 36 and pinion gear 26 (FIG. 3) relative to the housing. The force transmitting member 88 is disposed in a coaxial relationship with the pinion gear 26, shaft 42 and sleeve 40.

The force transmitting member 88 has a flat upper (as viewed in FIG. 4) annular major side surface 100 which engages the flat lower major side surface 96 of the base 24 of the housing 22. In addition, the force transmitting member 88 has a flat annular lower major side surface 102 which engages an annular end surface 104 on the end portion 90 of the cylindrical sleeve 40. Although the force transmitting member 88 is formed of metal, the force transmitting member could be formed of a suitable polymeric material if desired. The upper and lower side surfaces 100 and 102 on the force transmitting member 88 may have an arcuate cross sectional configuration as viewed in a diametrical plane through the force transmitting member.

Force is transmitted from the end surface 104 (FIG. 4) of the sleeve 40 through the annular force transmitting member 88 to the base 24 of the housing 22. This force presses the force transmitting member 88 against the base 24 of the housing 22. In addition, force is transmitted from the sleeve 40 to the shaft 42 to press the shoulder 78 against the upper side surface 94 of the base 24 of the housing 22.

During rotation of the pinion gear 26, the force transmitting member 88 either remains stationary relative to the housing 22 or rotates with the pinion gear and string post 36 relative to the housing. The annular end surface 104 on the end portion 90 of the sleeve 40 has a relatively small area compared to the upper major side surface 100 of the force transmitting member 88. Therefore, it is believed that the force transmitting member 88 will tend to remain stationary relative to the base 24 of the housing 22 during rotation of the pinion gear 26 and string post 36 relative to the housing. However, depending upon the coefficient of friction between the force transmitting member 88 and the housing 22 and between the force transmitting member and the sleeve 40, the force transmitting member may rotate with the sleeve. If desired, the force transmitting member 88 may be secured to the sleeve 40 or integrally formed as one piece with the sleeve.

In accordance with another feature of the invention, the sleeve 40 and shaft 42 are interconnected by a retainer 110 (FIG. 3). The retainer 110 includes a projection 112 which extends into an annular retainer groove 114 formed in the shaft 42. Although only a single retainer projection 112 has been illustrated in FIG. 3, it should be understood that a plurality of retainer projections 112 may be formed about the circumference of the sleeve 40 and extend into the annular retainer groove 114 at a plurality of locations about the periphery of the shaft 42. Alternatively, the retainer projection 112 may be formed with an annular configuration and be coextensive with the retainer groove 114.

The retainer projection 112 is integrally formed as one piece with a cylindrical side wall 118 of the metal sleeve 40 by indenting the metal sleeve. The sleeve 40 may be indented by engaging the sleeve with a punch in a manner similar to that disclosed in U.S. Pat. No. 4,353,280. If desired, the cylindrical side wall 118 of the sleeve 40 may be provided with an annular groove to reduce the cross section of the side wall of the sleeve in the manner disclosed in the aforementioned U.S. Pat. No. 4,353,280. The providing of such a groove in the side wall 118 of the sleeve 40 would facilitate indenting of the sleeve to form one or more retainer projections 112 which extend into the annular groove 114 in the shaft 42. The disclosure in the aforementioned U.S. Pat. No. 4,353,280 is hereby incorporated herein in its entirety by this reference thereto.

During indenting of the sleeve 40 to form one or more retainer projections 112, force is applied against annular radially extending side surfaces 122 and 124 (FIG. 4) of the groove 114 by the projections. This force pulls the shaft 42 axially downward (as viewed in FIG. 3) to press the annular bearing surface 76 on the shoulder 78 against the upper (as viewed in FIGS. 3 and 4) side surface 82 of the base 24 of the housing 22. In addition, as the retainer projections 112 are formed, the end surface 104 (FIG. 4) on the sleeve 40 is pressed against the force transmitting member to urge the force transmitting member 88 toward the lower (as viewed in FIG. 4) major side surface 96 of the base 24 of the housing 22.

In addition to the retainer 110 (FIG. 3), the sleeve 40 and shaft 42 are interconnected in a coaxial relationship by an interference fit between the shaft 42 and a cylindrical inner side surface 130 of a chamber 132 (FIG. 4) in the sleeve 40. The cylindrical inner side surface 130 of the chamber 132 has a diameter which is slightly smaller than the outside diameter of the shaft 42.

The shaft 42 has a cylindrical main section 136 (FIG. 4) which extends axially downward from the bearing 66 and is coaxial with the bearing. The annular retainer groove 114 is formed in the main section 136 of the shaft 42. This results in the main section 136 having a cylindrical portion 138 which is disposed downward (as viewed in FIG. 4) from the annular retainer groove 114. The cylindrical main section 136 and portion 138 of the shaft 42 have a diameter which is slightly greater than the diameter of the inner side surface 130 of the chamber 132 in the sleeve 40.

Knurling or splines 142 extend axially from the lower portion 138 of the main section 136 of the shaft 42 to the lower end of the shaft. The splines formed by the knurling 142 are disposed in a circular array having a maximum outside diameter which is slightly greater than the diameter of the inner side surface 130 of the chamber 132 in the sleeve 40.

When the shaft 42 and sleeve 40 are positioned in a telescopic relationship with each other (FIG. 3), there is an interference fit between the inner side surface 130 of the sleeve 40 and the exterior of the shaft 42. This interference fit is effective to retain the shaft 42 and sleeve 40 against movement relative to each other. The subsequent indenting of the sleeve 40 to form one or more projections 112 extending into the annular retainer groove 114 in the shaft 42 is effective to further interconnect the sleeve 40 and shaft 42 to hold them against movement relative to each other.

Grommet

The tuning device 14 (FIGS. 1–3) is mounted on the head end portion 10 of the string musical instrument 12 in a cylindrical opening 146 (FIG. 3) formed in the head end portion 10 of the string musical instrument. The cylindrical opening 146 has a diameter which is greater than the diameter of the string post 36. The annular force transmitting member 88 has an outside diameter which is the same as the inside diameter in the opening 146. Therefore, the force transmitting member 88 engages the cylindrical inner side surface of the opening 146 in the head end portion 10 of the musical instrument 12 to position the tuning device 14 on the musical instrument. This results in the string post 36 being disposed in a coaxial relationship with the opening 146.

Since the cylindrical string post 36 has an outside diameter which is smaller than the inside diameter of the opening 146, a metal grommet 150 is provided to position and support the string post 36 in the opening 146. The grommet 150 includes a cylindrical metal body portion 152. An annular metal flange 154 is integrally formed as one piece and is coaxial with the body portion 152. The cylindrical body portion 152 has an outside diameter which is the same as the inside diameter of the opening 146 in the head end portion 10 of the musical instrument 12.

The body portion 152 of the grommet 150 has a cylindrical central opening through which the string post 36 extends. The body portion 152 of the grommet 150 cooperates with the head end portion 10 of the musical instrument 12 to hold the string post 36 against transverse or sideways movement during playing of the musical instrument 12. However, the string post 36 is rotatable in the central opening in the grommet 150 upon manual rotation of the knob 34 and the resulting rotation of the pinion gear 26.

The flange 154 engages a side surface 156 or head end portion 10 of the musical instrument 12 to position the grommet 150 relative to the head end portion of the musical instrument. Suitable fasteners (screws) extend through holes formed in the grommet 150 to fixedly connect the grommet to the head end portion 10 of the musical instrument 12.

The base 24 of the housing 22 engages the side surface 158 of the head end portion 10 of the musical instrument 12 opposite from the grommet. The base 24 of the housing 22 is fixedly connected with the head end portion 10 of the musical instrument by suitable fasteners (screws). The base 24 of the housing 22 (FIG. 2) has a flat plate-like configuration so that the pinion 26 is exposed to view. However, it is contemplated that the housing 22 could be formed with side walls which extend upward from the base 24 and enclose the pinion 26 in a manner similar to that disclosed in U.S. Pat. Nos. 3,431,807 and 4,353,280 if desired.

Assembly

When the tuning device 14 is to be assembled, the one-piece pinion gear 26 and shaft 42 are positioned relative to the housing 22. To position the pinion gear 26 and shaft 42 relative to the housing 22, the shaft is moved axially into the opening 72 in the base 24 of the housing. Continued movement of the pinion gear 26 toward the base 24 of the housing 22 moves the bearing 66 into the opening 72. As this occurs, the annular bearing surface 76 on the lower (as viewed in FIGS. 3 and 4) side of the shoulder 78 moves into engagement with the upper major side surface 82 (FIG. 4) of the base of the housing 22.

Once the pinion gear 26 and shaft 42 have been positioned relative to the base 24 of the housing 22, the force transmitting member 88 is moved axially along the shaft 42 into engagement with the base 24 of the housing. This results in the upper (as viewed in FIG. 4) major side surface 100 of the force transmitting member 88 moving into engagement with the lower major side surface 96 on the base 24 of the housing 22.

After the force transmitting member 88 has been positioned relative to the shaft 42, the sleeve 40 is moved into a telescopic relationship with the shaft. Since the cylindrical shaft 42 has an outside diameter which is slightly greater than the inside diameter of the inner side surface 130 of the chamber 132 in the sleeve 40, there is an interference fit between the sleeve 40 and the shaft 42. Therefore, the shaft 42 must be forced into the chamber 132 in the sleeve 40.

When the shaft 42 and sleeve 40 are to be moved into a telescopic relationship, the end surface 140 (FIG. 4) on the sleeve 40 moves into engagement with the knurling 142 on the lower (as viewed in FIG. 4) end portion of the shaft 42. The application of axial forces to the sleeve 40 and shaft 42 moves the knurled end portion 142 of the shaft into the upper (as viewed in FIG. 4) portion of the chamber 132. As this occurs, the splines or ribs of the knurling 142 are deformed by the sleeve 40 and are effective to deform the sleeve.

Continued axial movement of the sleeve 40 onto the shaft 42 moves the upper (as viewed in FIG. 4) end portion 90 of the sleeve into engagement with the lower (as viewed in FIG. 4) portion 138 of the main section 136 of the shaft 42. Since the main section 136 of the shaft 42 has an outside diameter which is slightly greater than the inside diameter of the chamber 132, there is an interference between the material of the main section 136 of the shaft 42 and the material of the sleeve 40. However, the interference between the sleeve 40 and shaft 42 is not so great as to prevent the sleeve from being forced onto the shaft 42.

As the sleeve 40 is forced onto the shaft 42, force is transmitted from the end surface 104 (FIG. 4) of the sleeve 40 to the lower major side surface 102 of the force transmitting member 88. This results in the upper side surface 100 of the force transmitting member 88 being pressed against the lower side surface 96 of the base 24 of the housing 22. When the force transmitting member 88 is being pressed against the housing 22 by the sleeve 40, the sleeve and shaft 42 are in the telescopic relationship illustrated in FIG. 3.

While the force transmitting member 88 is pressed against the base 24 of the housing 22 with a predetermined force by the sleeve 40, the projection 112 (FIG. 3) is formed in the side wall 118 of the sleeve 40 to further interconnect the sleeve and the shaft 42. To form the projection 112, a punch is aligned with the retainer groove 114 and pressed against the sleeve 40. The force applied by the punch against the sleeve 40 indents the sleeve into the annular retainer groove 114 to form the projection 112 with the material of the sleeve. As the sleeve 40 is indented to form the projection 112, the material of the sleeve applies force against the lower (as viewed in FIG. 4) side surface 124 of the annular retainer groove 114 to press the bearing surface 76 (FIG. 3) on the shoulder 78 firmly against the upper (as viewed in FIG. 3) side surface 82 of the base 24 of the housing 22. At the same time, the force transmitting member 88 is pressed against the lower major side surface 96 of the housing 22.

After the tuning device 14 has been assembled in the foregoing manner, the tuning device may be positioned on the head end portion 10 of a stringed musical instrument 12. The head end portion 10 of the stringed musical instrument 12 has an opening 146 (FIG. 3) into which the tuning device 14 is inserted. Thus, the string post 36 is moved into axial alignment with the cylindrical opening 146. The string post 36 and force transmitting member 88 are then moved into the opening 146 in a manner illustrated in FIG. 3. Positioning of the force transmitting member 88 in the opening 146 is effective to center the string post 36 relative to the opening. At this time, the lower major side surface 96 on the base 24 of the housing 22 is pressed against the upper (as viewed in FIG. 3) major side surface 158 of the head end portion 10.

The grommet 150 is then positioned relative to the string post 36 and the opening 146 in the head end portion 10 of the stringed musical instrument 12. To accomplish this, a cylindrical central opening 172 in the metal grommet 150 is axially aligned with the string post 36. The grommet 150 is moved axially along the string post 36 to move the body portion 152 of the grommet 150 into the opening 146 in the head end portion 10 of the musical instrument 12. The flange 154 on the grommet 150 moves into engagement with the lower (as viewed in FIG. 3) side surface 156 of the head end portion 10 of the musical instrument 12.

The grommet 150 is then fixedly connected with the head end portion 10 of the musical instrument 12 with suitable fasteners (screws). In addition, the housing 22 is fixedly connected with the head end portion of the musical instrument with suitable fasteners (screws). Once the grommet 150 has been positioned relative to the head end portion 10 of the musical instrument 12, the grommet is effective to support the string post 36 for rotation about the axis 46 and to prevent transverse, that is, sideways, movement of the string post during playing of the musical instrument with the tensioning of the string 16 connected with the string post.

In the embodiment of the invention illustrated in FIGS. 3 and 4, the force transmitting member 88 is disposed between the end portion 90 of the sleeve 40 and the housing 22. However, it is contemplated that the force transmitting member 88 may be eliminated if desired. This may be accomplished by providing an annular flange on the end portion 90 of the sleeve 40. The annular flange on the end portion 90 of the sleeve 40 would be pressed against the lower major side surface 96 of the base 24 of the housing 22. This would allow the force transmitting member 88 to be eliminated.

It is also contemplated that the grommet 150 may be eliminated if desired. If the grommet 150 is to be eliminated, the opening 146 in the head end portion 12 of the musical instrument 10 may be sized as to engage the generally cylindrical exterior surface of the string post 36. If desired, a cylindrical metal or polymeric bearing may be inserted into the opening 146 between the string post 36 and the wooden head end portion 12 of the musical instrument 12. With or without a bearing, the string post would be supported against sideways movement by the head end portion 10 of the stringed musical instrument.

It is contemplated that the sleeve 40 may be connected with the shaft 42 in a manner other than using an interference fit and/or the retainer 110. For example, the sleeve 40 may be telescopically inserted onto a shaft 42, with or without an interference fit. The sleeve 40 and shaft 42 may then be drilled to form a diametrically extending opening through both the shaft and the sleeve. A pin may be inserted into the opening to interconnect the sleeve 40 and shaft 42. Of course, other known methods may be utilized to interconnect the sleeve 40 and shaft 42 if desired.

Alternative Retainer

In the embodiment of the invention illustrated in FIG. 3, the retainer 110 is formed as a projection 112 by indenting the material of the sleeve 40 into the retainer groove 114 in the shaft 42. The illustrated indentation is formed by pressing the material of the side wall 118 of the sleeve into the annular groove 114 with a punch to form a projection having a cross sectional configuration which corresponds to the cross sectional configuration of the annular groove. In the embodiment of the invention illustrated in FIG. 5, the retainer projection has a cross sectional configuration which is different from the cross sectional configuration of the annular retainer groove. Since the embodiment of the invention illustrated in FIG. 5 is generally similar to the embodiment of the invention illustrated in FIGS. 1–4, similar numerals will be utilized to identify similar components, the suffix letter "a" being associated with numerals of FIG. 5 to avoid confusion.

A tuning device 14*a* for the string of a musical instrument includes the pinion gear 26*a* of a shaft 42*a*. A bearing 66*a* is integrally formed as one piece with the shaft 42*a* and pinion gear 26*a*. The bearing 66*a* is disposed in an opening 72*a* formed in a base 24*a* of a housing 22*a*. The housing 22*a* is disposed in engagement with a head end portion 10*a* of a musical instrument 12*a*.

The cylindrical metal sleeve 40*a* extends around the cylindrical metal shaft 42*a* to form a string post 36*a*. The sleeve 40*a* has an end portion which is adapted to be connected with a string of a musical instrument in the same manner as previously described in conjunction with the embodiment of the invention illustrated in FIGS. 1–4. An annular force transmitting member 88*a* is disposed between an upper end portion 90*a* of the sleeve 40*a* and the base 24*a* of the housing 22*a*.

Figure 5:
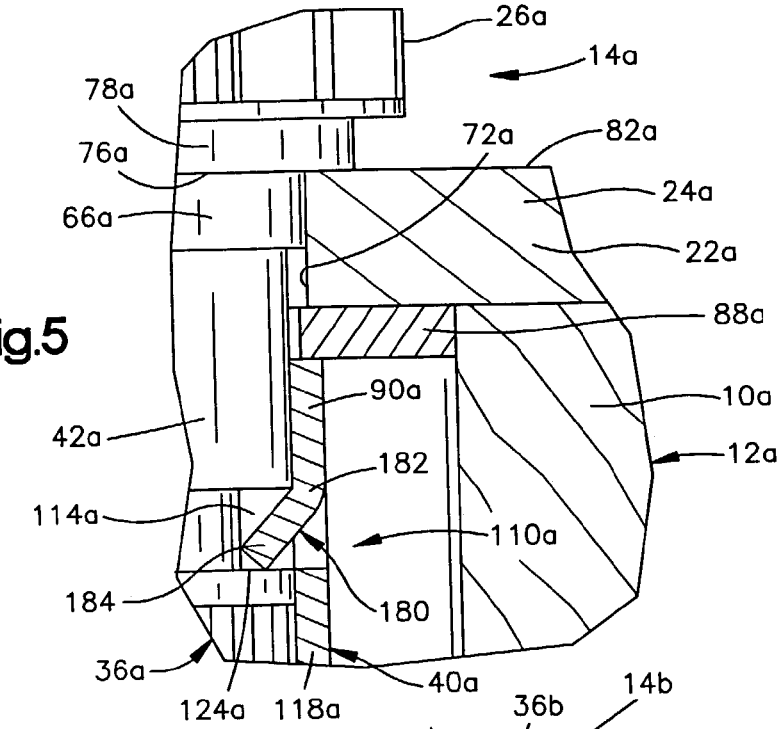
FIG. 5 is an enlarged fragmentary illustration of an alternative retainer portion which may be utilized with the tuning device of FIGS. 1–4.

A retainer 110*a* is constructed in accordance with a feature of the embodiment of the invention illustrated in FIG. 5 and is effective to interconnect the sleeve 40*a* and the shaft 42*a*. The retainer 110*a* includes a metal tang 180. The tang 180 has a cantilevered construction and extends into an annular retainer groove 114*a* formed in the shaft 42*a*. The tang 180 has a base 182 formed at a bend between the tang and a side wall 118*a* of the sleeve 40*a*. In addition, the tang has a free end portion 184 which engages a side surface 124*a* of the retainer groove 114*a*.

The tang 180 is cut from the side wall 118*a* of the sleeve 40*a* and is pressed into the groove 14*a* by a suitable punch. As the tang 180 is formed from the side wall 118*a* of the sleeve 40*a*, the free end portion 184 of the tang swings inward and presses the annular side surface 124*a* of the retainer groove 114*a* downward (as viewed in FIG. 5). This downward force is transmitted to the shaft 42*a* by the tang 180 and is effective to press the bearing surface 76*a* on a shoulder 78*a* against a side surface 82*a* of the base 24*a* of the housing 22*a*. In addition, the downward force applied by the tang 180 against the shaft 42*a* is effective to urge the sleeve 40*a* in an upward direction (as viewed in FIG. 5). This results in the end portion 90*a* of the sleeve 40*a* being pressed firmly against the force transmitting member 88*a*.

The resilience of the metal of the sleeve 40*a* which forms the tang 180 causes the tang to function as a spring. This results in the free end portion 184 of the tang 180 continuously applying a spring force against the shaft 42*a*. This continuous spring force is effective to constantly to urge the bearing surface 76*a* into engagement with the side surface 82*a* of the base 24*a* of the housing 22*a*.

Grommet Wear

Compensation

In the embodiment of the invention illustrated in FIGS. 1–4 the grommet 150 is provided with a cylindrical central opening 172 through which the string post 36 extends. The opening 172 in the grommet 150 may become worn with the establishment of excessive clearance between the string post 36 and the grommet 150. This excessive clearance may allow the string post 36 to vibrate in a manner which a player of a stringed instrument 12 would find to be objectionable.

Figure 6:
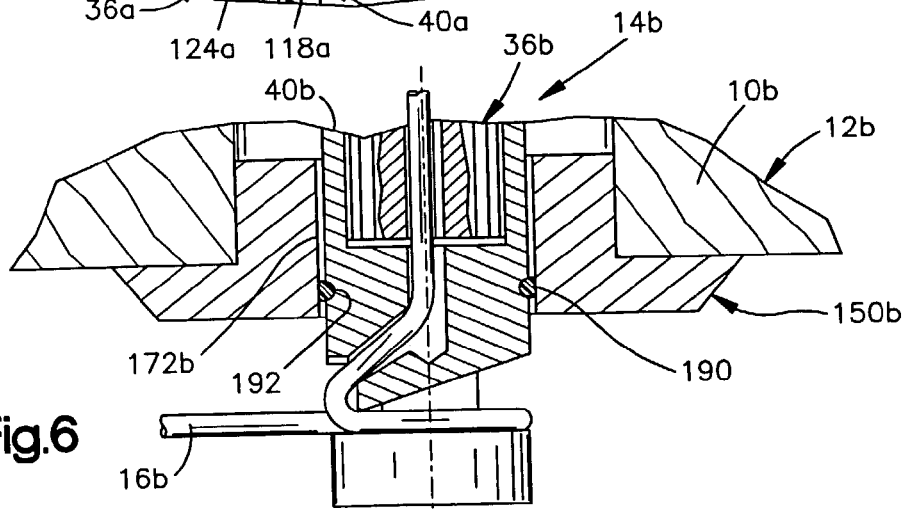
FIG. 6 is an enlarged fragmentary schematic illustration depicting the manner in which a ring is disposed on a sleeve the tuning device of FIG. 3 to compensate for wear of an opening in a grommet which supports the sleeve of the tuning device.

In the embodiment of the invention illustrated in FIG. 6, a bearing ring is provided to compensate the wear of the opening in the grommet 150 of FIG. 3. Since the embodiment of the invention illustrated in FIG. 6 is generally similar to the embodiment of the invention illustrated in FIGS. 1–4, similar numerals will be utilized to designate similar components, the suffix letter "b" being associated with the numerals of FIG. 6 to avoid confusion.

A tuning device 14*b* is connected with a head end portion 10*b* of a stringed musical instrument 12*b*. The tuning device 14*b* is utilized to vary tension in a string 16*b* of the musical instrument. The tension device 14*b* has the same construction as the tensioning device 14 of FIGS. 1–4.

In accordance with the feature of the embodiment of the invention illustrated in FIG. 6, an annular bearing ring 190 is provided in an annular groove 192 formed in a sleeve 40*b* of a string post 36*b* of the tuning device 14*b*. The bearing ring 190 engages an inner side surface of the opening 172*b* formed in a grommet 150*b*. The bearing ring 190 projects radially out of the groove 192 for a distance sufficient to compensate for clearance between the exterior of the sleeve 40*b* and the inner side surface of the opening 172*b* in the grommet 150*b*. The bearing ring 190 is formed of a suitable polymeric material, such as tetrafluoroethylene (TEFLON) (trademark). Of course, the bearing ring 190 could be formed of a different material if desired.

In the embodiment of the invention illustrated in FIG. 6, the bearing ring 190 which compensates for wear of the opening 172*b* in the grommet 150*b* is mounted on the string post 36*b*. In the embodiment of the invention illustrated in FIG. 7, the bearing ring is mounted on the grommet. Since the embodiment of the invention illustrated in FIG. 7 is generally similar to the embodiments of the invention illustrated in FIGS. 1–6, similar numerals will be utilized to designate similar components, the suffix letter "c" being associated with the numerals of FIG. 7 to avoid confusion.

A tuning device 14*c* is connected with a head end portion 10*c* of a stringed musical instrument 12*c*. A tuning device 14*c* includes a string post 36*c* having a same construction as the string post 36 of FIG. 3. A string post 36*c* includes a shaft 42*c* which is telescopically received in a sleeve 40*c*. The string post 36*c* extends through an opening 172 in a grommet 150*c*.

Figure 7:
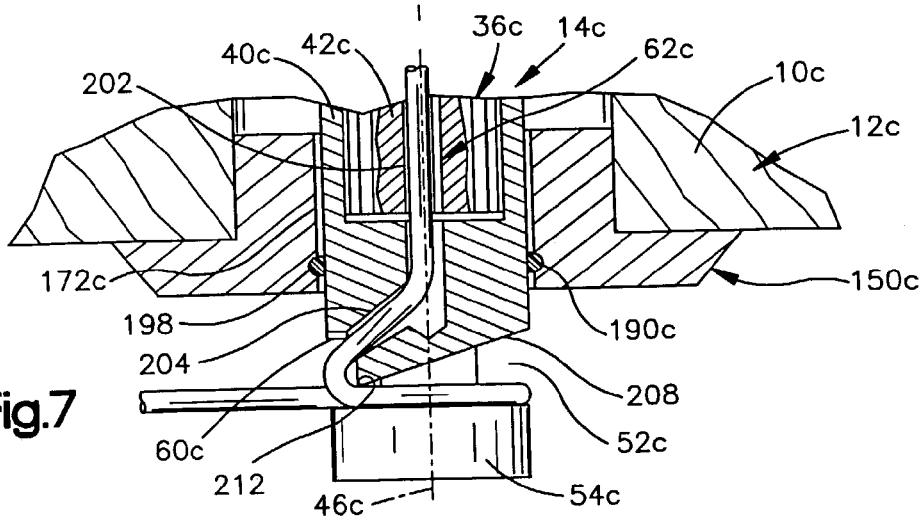
FIG. 7 is a schematic illustration, generally similar to FIG. 6, of a grommet having a ring which compensates for wear of an opening in the grommet.

In accordance with a feature of the embodiment of the invention illustrated in FIG. 7, a bearing ring 190*c* is received in an annular groove 198 formed on the inside of the grommet 150*c*. The bearing ring 190*c* presses against the outside surface of the sleeve 40*c* and supports the sleeve for rotation relative to the grommet 150*c*. The bearing ring 190*c* holds the string post 14*c* against transverse or sideways movement during playing of the musical instrument 12*c*. Although only a single bearing ring 190 or 190*c* has been illustrated in FIG. 6 or 7 in association with a grommet 150*b* or 150*c*, it is contemplated that a plurality of bearing rings may be provided. Thus, the plurality of grooves, corresponding to the groove 192 of FIG. 6, may be provided in the sleeve 40*b* to receive a plurality of bearing rings 190. Similarly, a plurality of grooves corresponding to the groove 198 may be formed in the grommet 150*c* to receive a plurality of bearing rings 190*c*. If desired, bearing rings may be mounted in both one or more grooves in the sleeve 40*b* or 40*c* and one or more grooves in the grommet 150*b* or 150*c*.

String Connection

It is contemplated that the strings 16 (FIG. 1), 16*b* (FIG. 6), and/or 16*c* (FIG. 7) may be connected with a string post 36, 36*b*, or the 36*c* in any one of many known ways. However, as was previously mentioned, it is believed that it may be desired to connect the string with the string post in the manner similar to that disclosed in U.S. patent application Ser. No. 10/102,118 filed Mar. 20, 2002 by Robert J. Sperzel and entitled Device For Tuning A String Of A Musical Instrument.

When the string 16*c* is to be connected with the string post 36*c* in the manner described in the aforementioned application Ser. No. 10/102,118, a string passage 62*c* extends from the annular groove 52*c* through the string post 36*c* and the pinion gear corresponding to the pinion gear 26 of FIG. 3. The string passage 62*c* includes a cylindrical central passage 202 which extends along the central axis 46*c* of the string post 36*c*. The central passage 202 extends only partway through the string post 36*c*.

In addition, the string passage 62*c* includes a cylindrical transverse passage 204 which intersects the central passage 202 and extends only partway through the string post 36*c*. The transverse passage 204 may have a central axis which is skewed at an acute angle relative to the central axis 46*c* of the central passage 202. The slot 54*c* in the string post 36*c* has a bottom surface 208 which extends through and is skewed at an acute angle to the central axis 46*c* of the string post 36*c*. The string 16*c* extends around a portion of the groove 52*c* into the slot 54*c*. the string extends across a sharp corner 212 into the opening 60*c* to the string passage 62*c*.

Although one specific way of connecting the string 16*c* with the string post 36*c* has been illustrated schematically in FIG. 7, it should be understood that the string 16*c* could be connected with the string post 36 in a different manner if desired.

CONCLUSION

In view of the foregoing description, it is apparent that the present invention provides a new and improved apparatus 14 for use in tuning a string 16 of a musical instrument 12. The apparatus 14 includes a housing 22 and a pinion gear 26 which is disposed adjacent to a base 24 of the housing 22. A shaft 42 extends from the pinion gear 26. A sleeve 40 may be connected with the shaft 42 and enclose an end portion 50 of the shaft. The sleeve 40 may have an end portion 50 which receives the string 16 of the musical instrument 12.

The shaft 42 may advantageously be integrally formed as one piece with the pinion gear 26. To connect the shaft 42 and pinion gear 26 with the housing 22, a force transmitting member 88 may be provided between an end portion 90 of the sleeve 40 and the housing 22. A retainer portion 110 of the sleeve 40 may extend into engagement with a recess 114 in the shaft 42 to interconnect the sleeve and shaft. If desired, a grommet 150 may extend around the sleeve 40 to retain the sleeve against transverse movement relative to the musical instrument while supporting the sleeve for rotational movement relative to the musical instrument.

Tuning devices 14 constructed in accordance with the present invention may be utilized on many different types of stringed musical instruments, including guitars of the vintage and non-vintage type. The tuning devices 14 may be utilized in association with banjos or mandolins. It should be understood that a, tuning device 14 having one or more features of the present invention may be utilized in association with any desired type of stringed musical instrument.

The tuning devices 14 of the present invention have a plurality of features. These features may be utilized in various combinations with each other. Alternatively, the features may be used separately in association with features of known devices.

Having described the invention, the following is claimed:

1. An apparatus for use in tuning a string of a musical instrument, said apparatus comprising a housing having a base, a pinion gear disposed adjacent to said base of said housing, a shaft extending from said pinion gear, and a sleeve connected to said shaft and enclosing an end portion of said shaft, said sleeve having an end portion with a recess to receive the string of the musical instrument, said pinion gear being urged toward said base of said housing by force transmitted between said shaft and said sleeve.

2. An apparatus as set forth in claim 1 further including a force transmitting member disposed between a second end portion of said sleeve and said base of said housing to transmit force between said sleeve and said base of said housing.

3. An apparatus as set forth in claim 1 wherein said shaft includes a circumferential groove which is engaged by a projecting portion of said sleeve to prevent axial movement of said sleeve relative to said shaft.

4. An apparatus as set forth in claim 1 wherein said pinion gear and said shaft are integrally formed as one piece.

5. An apparatus as set forth in claim 1 wherein at least a portion of said shaft has an interference fit with an inner surface of said sleeve to retain said shaft and sleeve against relative movement.

6. An apparatus as set forth in claim 1 wherein said recess in said end portion of said sleeve includes an annular groove which extends around said sleeve and receives a portion of the string of the musical instrument.

7. An apparatus as set forth in claim 1 wherein said recess in said end portion of said sleeve includes a slot which extends across said end portion of said sleeve and receives a portion of the string of the musical instrument.

8. An apparatus as set forth in claim 1 further including a first bearing surface connected with said pinion gear and said shaft, said first bearing surface being disposed in engagement with a second bearing surface on said base of said housing, said shaft having a generally cylindrical configuration with a diameter which is less than a diameter of said first and second bearing surfaces.

9. An apparatus as set forth in claim 8 wherein said pinion gear, said first bearing surface and said shaft are integrally formed as one piece.

10. An apparatus as set forth in claim 1 wherein said apparatus further includes a worm rotatably supported by said housing, said worm being disposed in meshing engagement with said pinion gear, said housing having an outer wall which extends parallel to said base and extends across at least a portion of said worm, said outer wall of said housing being at least partially offset to one side of said pinion gear to expose said pinion gear.

11. An apparatus as set forth in claim 1 wherein said base of said housing is a flat plate, said housing having side walls which extend upward from said flat plate and an outer wall which extends between said side walls, said side walls and outer wall of said housing being offset to one side of an axis of rotation of said pinion gear to leave said pinion gear exposed to view during playing of the musical instrument.

12. An apparatus as set forth in claim 1 further including a force transmitting member having first and second major side surfaces and a circular central opening extending between said first and second major side surfaces, said first major side surface being disposed in engagement with said base of said housing, said second major side surface being disposed in engagement with a second end portion of said sleeve, said shaft extends through the circular central opening in said force transmitting member.

13. An apparatus as set forth in claim 1 further including a bearing integrally formed as one piece with said pinion gear and said shaft, said bearing being disposed in a circular opening in said base of said housing.

14. An apparatus as set forth in claim 1 wherein said pinion gear, shaft and sleeve at least partially define a central passage which extends through said pinion gear and shaft and only part way through said sleeve, said central passage has an end surface area disposed in said end portion of said sleeve, said end portion of said sleeve at least partially defines a transverse passage which extends only part way through said end portion of said sleeve and intersects said central passage, said transverse passage and said central passage form a passage through which the string of the musical instrument extends.

15. An apparatus as set forth in claim 1 wherein said recess in said end portion of said sleeve includes an annular groove which extends around said end portion of said sleeve and a slot which extends inward from an end surface on said end portion of said sleeve, said apparatus further includes a string passage which is spaced from said slot and has an opening in said annular groove, said pinion gear being rotatable relative to said housing to rotate said sleeve with a portion of the string of the musical instrument extending from the groove in the end portion of said sleeve into the slot in the end portion of the sleeve and extending from the groove in the end portion of said sleeve into the string passage.

16. An apparatus for use in tuning a string of a musical instrument, said apparatus comprising a housing having a base, a rotatable pinion gear disposed adjacent to said base of said housing, a rotatable shaft extending from said pinion gear, said shaft being integrally formed as one piece with said pinion gear, and a rotatable sleeve connected to said shaft and enclosing an end portion of said shaft, said sleeve having an end portion to receive the string of the musical instrument, said pinion gear, shaft and sleeve being rotatable together relative to said housing.

17. An apparatus as set forth in claim 16 further including a force transmitting member disposed between a second end portion of said sleeve and said base of said housing to transmit force between said sleeve and said base of said housing.

18. An apparatus as set forth in claim 16 wherein said shaft includes a circumferential groove which is engaged by a projecting portion of said sleeve to prevent axial movement of said sleeve relative to said shaft.

19. An apparatus as set forth in claim 16 wherein said shaft is telescopically received in an opening in said sleeve and has an end surface which is disposed in said sleeve, said first end portion of said sleeve extends across said end surface of said shaft.

20. An apparatus as set forth in claim 16 wherein at least a portion of said shaft has an interference fit with an inner surface of said sleeve to retain said shaft and sleeve against relative movement.

21. An apparatus as set forth in claim 16 wherein said sleeve includes an annular groove which extends around said sleeve and receives a portion of the string of the musical instrument.

22. An apparatus as set forth in claim 16 wherein said sleeve includes a slot which extends across said first end portion of said sleeve and receives a portion of the string of the musical instrument.

23. An apparatus as set forth in claim 16 further including a first bearing surface connected with said pinion gear and said shaft, said first bearing surface being disposed in engagement with a second bearing surface on said base of said housing, said shaft having a generally cylindrical configuration with a diameter which is less than a diameter of said first and second bearing surfaces.

24. An apparatus as set forth in claim 23 wherein said pinion gear, said first bearing surface and said shaft are integrally formed as one piece.

25. An apparatus as set forth in claim 16 wherein said apparatus further includes a worm rotatably supported by said housing, said worm being disposed in meshing engagement with said pinion gear, said housing having an outer wall which extends parallel to said base and extends across at least a portion of said worm, said outer wall of said housing being at least partially offset to one side of said pinion to expose said pinion gear when said pinion gear.

26. An apparatus as set forth in claim 16 wherein said base of said housing is a flat plate said housing having side walls which extend upward from said flat plate and an outer wall which extends between side walls of said housing, said side walls and outer wall of said housing being offset to one side of an axis of rotation of said pinion gear to leave said pinion gear exposed to view during playing of the musical instrument.

27. An apparatus as set forth in claim 16 further including a force transmitting member having first and second major side surfaces and a circular central opening extending between said first and second major side surfaces, said first major side surface being disposed in engagement with said base of said housing, said second major side surface being disposed in engagement with a second end portion of said sleeve, said shaft extends through the circular central opening in said force transmitting member.

28. An apparatus as set forth in claim 16 further including a bearing integrally formed as one piece with said pinion gear and said shaft, said bearing being disposed in a circular opening in said base of said housing.

29. An apparatus as set forth in claim 16 wherein said pinion gear, shaft and sleeve at least partially define a central passage which extends through said pinion gear and shaft and only part way through said sleeve, said central passage has an end surface area disposed in said end portion of said sleeve, said end portion of said sleeve at least partially defines a transverse passage which extends only part way through said end portion of said sleeve and intersects said central passage, said transverse passage and said central passage form a passage through which the string of the musical instrument extends.

30. An apparatus as set forth in clam 16 wherein said end portion of said sleeve includes an annular groove which extends around said end portion of said sleeve and a slot which extends inward from an end surface on said end portion of said sleeve, said apparatus further includes a string passage which is spaced from said slot and has an opening in said annular groove, said pinion gear being rotatable relative to said housing to rotate said sleeve with a portion of the string of the musical instrument extending from the groove in the end portion of said sleeve into the slot in the end portion of the sleeve and extending from the groove in the first end portion of said sleeve into the string passage.

31. An apparatus for use in tuning a string of a musical instrument, said apparatus comprising a housing having a base, a pinion gear disposed adjacent to said base of said housing, a shaft extending from said pinion gear, a sleeve connected to said shaft and enclosing an end portion of said shaft, said sleeve having a first end portion to receive the string of a musical instrument, and a force transmitting member having first and second major side surfaces, said first major side surface being disposed in engagement with said base of said housing, said second major side surface being disposed in engagement with a second end portion of said sleeve.

32. An apparatus as set forth in claim 31 wherein said force transmitting member is effective to transmit force between said second end portion of said sleeve and said base of said housing.

33. An apparatus as set forth in claim 31 wherein said shaft includes a circumferential groove which is engaged by a projecting portion of said sleeve to prevent axial movement of said sleeve relative to said shaft.

34. An apparatus as set forth in clam 31 wherein said pinion gear and said shaft are integrally formed as one piece.

35. An apparatus as set forth in claim 31 wherein at least a portion of said shaft has an interference fit with an inner surface of said sleeve to retain said shaft and sleeve against relative movement.

36. An apparatus as set forth in claim 31 wherein said first end portion of said sleeve includes an annular groove which extends around said sleeve and receives a portion of the string of the musical instrument.

37. An apparatus as set forth in claim 31 wherein said first end portion of said sleeve includes a slot which extends across said first end portion of said sleeve and receives a portion of the string of the musical instrument.

38. An apparatus as set forth in claim 31 further including a first bearing surface connected with said pinion gear and said shaft, said first bearing surface being disposed in engagement with a second bearing surface on said base of said housing, said shaft having a generally cylindrical configuration with a diameter which is less than a diameter of said first and second bearing surfaces.

39. An apparatus as set forth in claim 38 wherein said pinion gear, said first bearing surface and said shaft are integrally formed as one piece.

40. An apparatus as set forth in claim 31 wherein said apparatus further includes a worm rotatably supported by said housing, said worm being disposed in meshing engagement with said pinion gear, said housing having an outer wall which extends parallel to said base and extends across at least a portion of said worm, said outer wall of said housing being at least partially offset to one side of said pinion gear to expose said pinion when said pinion gear.

41. An apparatus as set forth in claim 31 wherein said base of said housing is a flat plate, said housing having side walls which extend upward from said flat plate and an outer wall which extends between said side walls, said side walls and outer wall of said housing being offset to one side of an axis of rotation of said pinion gear to leave said pinion gear exposed to view during playing of the musical instrument.

42. An apparatus as set forth in claim 31 further including a bearing integrally formed as one piece with said pinion gear and said shaft, said bearing being disposed in a circular opening in said base of said housing.

43. An apparatus as set forth in claim 31 wherein said pinion gear, shaft and sleeve at least partially define a central passage which extends through said pinion gear and shaft and only part way through said sleeve, said central passage has an end surface area disposed in said first end portion of said sleeve, said first end portion of said sleeve at least partially defines a transverse passage which extends only part way through said first end portion of said sleeve and intersects said central passage, said transverse passage and said central passage form a passage through which the string of the musical instrument extends.

44. An apparatus as set forth in claim 31 wherein said first end portion of said sleeve includes an annular groove which extends around said first end portion of said sleeve and a slot which extends inward form an end surface on said first end portion of said sleeve, said apparatus further includes a string passage which is spaced from said slot and has an opening in said annular groove, said pinion gear being rotatable relative to said housing to rotate said sleeve with a portion of the string of the musical instrument extending from the groove in the first end portion of said sleeve into the slot in the first end portion of the sleeve and extending from the groove in the first end portion of said sleeve into the string passage.

45. An apparatus for use in tuning a string of a musical instrument, said apparatus comprising a housing having a base, a rotatable pinion gear disposed adjacent to said base of said housing, a rotatable shaft extending from said pinion gear, and a rotatable sleeve connected to said shaft and enclosing an end portion of said shaft, said sleeve having an end portion to receive the string of the musical instrument, said sleeve having a retainer portion which extends inward from a side wall of said sleeve into engagement with a recess in said shaft, said retainer portion of said sleeve being integrally formed as one piece with said side wall of said sleeve, said pinion gear, shaft and sleeve being rotatable together relative to said housing.

46. An apparatus as set forth in claim 45 wherein the retainer portion of said sleeve is effective to apply a force against the recess in said shaft urging said shaft in a direction away from said pinion gear.

47. An apparatus as set forth in claim 45 wherein the retainer portion of said sleeve includes a tang having a base connected to said sleeve and a free end portion disposed in engagement with the recess in said shaft.

48. An apparatus as set forth in claim 45 wherein said retainer portion of said sleeve includes an indentation formed in said sleeve and projecting into the recess in said shaft.

49. An apparatus as set forth in claim 45 further including a gromment extending around said sleeve to retain said sleeve against transverse movement relative to the musical instrument while supporting said sleeve for rotational movement relative to the musical instrument.

50. An apparatus as set forth in claim 49 further including a ring disposed between said sleeve and said gromment to transmit force between said sleeve and said gromment.

51. An apparatus as set forth in claim 45 wherein said shaft is integrally formed as one piece with said pinion gear.

52. An apparatus as set forth in claim 45 wherein said pinion gear is urged toward said base of said housing by force transmitted between said shaft and said sleeve through said retainer portion of said sleeve.

53. An apparatus as set forth in claim 45 further including a force transmitting member having first and second major side surfaces, said first major side surface being disposed in engagement with said base of said housing, said second major side surface being disposed in engagement with a second end portion of said sleeve.

54. An apparatus as set forth in claim 53 wherein said force transmitting member is effective to transmit force between said sleeve and said base of said housing.

55. An apparatus as set forth in claim 53 wherein said retainer portion of said sleeve is effective to apply force against the recess in said shaft, said force transmitting member being effective to transmit force from said sleeve to said base of said housing.

56. An apparatus as set forth in claim 45 wherein at least a portion of said shaft has an interference fit with an inner surface of said sleeve to retain said shaft and sleeve against relative movement.

57. An apparatus for use in tuning a string of a musical instrument said apparatus comprising a housing having a base connected with the musical instrument, a pinion gear disposed adjacent to said base of said housing, a shaft extending from said pinion gear, a sleeve connected to said shaft and enclosing an end portion of said shaft, said sleeve having an end portion with a recess to receive the string of the musical instrument, and a gromment extending around said sleeve at a location disposed between said recess and said housing to retain said sleeve against transverse movement relative to the musical instrument while supporting said sleeve for rotational movement relative to the musical instrument.

58. An apparatus as set forth in claim 57 further including a ring disposed between said sleeve and said gromment to transmit force between said sleeve and said gromment.

59. An apparatus as set forth in claim 57 wherein said sleeve includes an annular groove which is enclosed by said gromment, said apparatus further includes a ring disposed in said annular groove in said sleeve and disposed in engagement with said gromment to transmit force between said sleeve and said gromment.

60. An apparatus as set forth in claim 57 wherein said gromment includes an annular groove which extends around said sleeve, said apparatus further includes a ring disposed in said annular groove in said gromment and disposed in engagement with said sleeve to transmit force between said sleeve and gromment.

61. An apparatus as set forth in claim 57 wherein said pinion gear is urged toward said base of said housing by force transmitted between said shaft and said sleeve.

62. An apparatus as set forth in clam 57 wherein said shaft is integrally formed as one piece with said pinion gear.

63. An apparatus as set forth in claim 57 further including a force transmitting member having a first and second major side surfaces, said first major side surface being disposed in engagement with said base of said housing, said second major side surface being disposed in engagement with a second end portion of said sleeve.

64. An apparatus as set forth in claim 57 wherein said sleeve has a retainer portion which extends inward from a side wall of said sleeve into engagement with a recess in said shaft, said retainer portion being integrally formed as one piece with said side wall of said sleeve.

65. An apparatus as set forth in claim 64 wherein said retainer portion of said sleeve includes a tang having a base connected to said sleeve and a free end portion disposed in engagement with the recess in said shaft.

66. An apparatus as set forth in claim 64 wherein said retainer portion of said sleeve includes an indentation formed in said sleeve and projecting into the recess in said shaft.

67. An apparatus for use in tuning a string of a musical instrument, said apparatus comprising a housing having a base, a pinion gear disposed adjacent to said base of said housing, a shaft extending from said pinion gear, said shaft being integrally formed as one piece with said pinion gear, a sleeve connected to said shaft and enclosing an end portion of said shaft, said sleeve having an end portion to receive the string of the musical instrument, said sleeve having a retainer portion which extends inward from a side wall of said sleeve into engagement with a recess in said shaft to retain said sleeve against movement relative to said shaft, said pinion gear being urged toward said base of said housing by force transmitted between said shaft and said sleeve through said retainer portion of said sleeve, a force transmitting member having first and second major side surfaces, said first major side surface being disposed in engagement with said base of said housing, said second major side surface being disposed in engagement with a second end portion of said sleeve.

68. An apparatus as set forth in claim 67 further including a gromment extending around said sleeve and connected with the musical instrument to retain said sleeve against transverse movement relative to the musical instrument while supporting said sleeve for rotational movement relative to the musical instrument.

* * * * *